US007040409B2

(12) United States Patent
Sangla

(10) Patent No.: US 7,040,409 B2
(45) Date of Patent: May 9, 2006

(54) SAFETY VALVE FOR OIL WELLS

(75) Inventor: Jean-Robert Sangla, Pau (FR)

(73) Assignees: Institut Francais du Petrole, Rueil Malmaison Cedex (FR); Societe Pyreneenne de Metallurgie, Pau (FR)

( * ) Notice: Subject to any disclaimer, the term of this patent is extended or adjusted under 35 U.S.C. 154(b) by 233 days.

(21) Appl. No.: 10/466,484

(22) PCT Filed: Jan. 16, 2002

(86) PCT No.: PCT/FR02/00155

§ 371 (c)(1),
(2), (4) Date: Oct. 15, 2003

(87) PCT Pub. No.: WO02/063129

PCT Pub. Date: Aug. 15, 2002

(65) Prior Publication Data

US 2004/0045722 A1 Mar. 11, 2004

(30) Foreign Application Priority Data

Feb. 2, 2001 (FR) ..... 01 01390

(51) Int. Cl.
*E21B 33/00* (2006.01)

(52) U.S. Cl. ..... 166/374; 166/134

(58) Field of Classification Search ..... 166/374, 166/120, 133, 134

See application file for complete search history.

(56) References Cited

U.S. PATENT DOCUMENTS

| | | | | |
|---|---|---|---|---|
| 3,910,352 A | | 10/1975 | Mott | 166/315 |
| 4,288,082 A | | 9/1981 | Setterberg, Jr. | 277/125 |
| 4,691,776 A | | 9/1987 | Pringle | 166/319 |
| 5,094,294 A | | 3/1992 | Bayh, III | 166/106 |
| 5,305,828 A | | 4/1994 | White et al. | 166/120 |
| 5,361,834 A | * | 11/1994 | Cox | 166/120 |
| 5,857,520 A | | 1/1999 | Mullen et al. | 166/196 |
| 5,865,255 A | * | 2/1999 | Hammett et al. | 166/382 |

FOREIGN PATENT DOCUMENTS

| | | |
|---|---|---|
| FR | 2 734 863 | 5/1995 |
| WO | 00/12862 | 3/2000 |

* cited by examiner

*Primary Examiner*—William Neuder
(74) *Attorney, Agent, or Firm*—Antonelli, Terry, Stout and Kraus, LLP.

(57) ABSTRACT

The present invention relates to a well safety valve set in a production tubing, comprising a body (17) including shutoff means (18) for shutting off a passage inside the body, anchor means (19) for anchoring the body in the tubing, sealing means (20) between the body and the wall of the tubing, the valve comprising communication means (14) for a hydraulic pressure between the valve and the surface of the well. According to the invention, the shutoff, anchor and sealing means include hydraulic activation means such that the hydraulic pressure transmitted from the surface activates the means so as to open the passage, anchor the valve in the tubing and activate the sealing means on the wall of the tubing.

The invention also relates to a method for setting the valve.

19 Claims, 4 Drawing Sheets

Art Antérieur

SAFETY VALVE FOR OIL WELLS

FIELD OF THE INVENTION

The present invention relates to a method for placing an oilwell equipped or not with a defective subsurface safety valve under safe conditions.

It is well-known that, for safety reasons, oilwells are generally equipped with subsurface safety valves which are either interposed between the connection of two tubing elements or inserted in a nipple housed in the production tubing of the well at a depth of some ten or hundred meters. The function of these valves is to allow to automatically stop effluent production if an operating trouble occurs at the wellhead or downstream therefrom. They are often controlled from the surface by a hydraulic pressure on the opening side and they automatically close by means of a powerful return spring when a hydraulic pressure drop, whether controlled or accidental, appears on the control line.

The hydraulic control line can also have defects (leakage, clogged or broken line), in which case the safety valve can no longer fulfil its function. It generally remains closed under the action of its spring and shuts off the effluent passage.

BACKGROUND OF THE INVENTION

Operators currently have two solutions to overcome this deficiency. They can withdraw the safety valve from the production tubing (after setting an air lock at the wellhead) and then close the defective control line by setting in the tubing an isolating sleeve provided with packers which isolate the control fluid arrival through the nipple. The well can produce again but it is then outside the safety standards since it is no longer equipped with a subsurface safety valve. Another solution allowing to avoid this off-standard operation consists in "killing" the well, i.e. in balancing the pressure of the reservoir with a hydrostatic mud column of suitable density, then in carrying out servicing operations in the well to repair according to the techniques used in the trade. This solution, which afterwards allows to work according to the safety standards, is extremely heavy and expensive.

Document FR-2,734,863 describes a method and a device allowing to restore well safety by setting, according to the standards in use in the trade, a special safety valve. However, the technique according to this document requires running out the defective subsurface valve and re-using its nipple for installing the special valve. The method thus requires a precise depth for fastening the new valve, considering the re-use of the nipple for its locking system and sealing.

The present invention relates to a well safety valve comprising improvements in relation to the special valve and the tools as described in the aforementioned document FR-2,734,863. The present valve according to the invention can be set directly in the inner space of a production tubing of known inside diameter, without requiring an adapted nipple. Thus, the length of the connecting rods between the valve and the wellhead at the surface no longer has to be adjusted.

SUMMARY OF THE INVENTION

The present invention thus relates to a well safety valve set in a production tubing, comprising a body comprising shutoff means for shutting off a passage inside the body, anchor means for anchoring the body in the tubing, sealing means between the body and a wall of the tubing, the valve comprising communication means for a hydraulic pressure between the valve and the surface of the well. According to the invention, the shutoff, anchor and sealing means comprise hydraulic activation means such that the hydraulic pressure transmitted from the surface activates the means so as to open said passage, anchor the valve in the tubing and activate the sealing means on the wall of the tubing.

The shutoff means can comprise a shutoff valve held in closed position by a return means, a hydraulic piston providing under pressure longitudinal displacement of a sleeve so as to hold the shutoff valve open.

The anchor means can comprise rams that can be displaced radially against the tubing wall by an anchor sleeve of a hydraulic piston.

The anchor means can be mechanically locked by immobilization means of the anchor sleeve.

The sealing means can include a pile of several ring-type joints made of a resilient material which can be compressed by the displacement of a compression sleeve of a hydraulic piston.

The section of the ring-type joints can be V-shaped with an unsymmetrical shape of the branches of the V, the branch in inner contact with the body of the valve being the shorter, the branch in contact with the tubing wall, after compression of the pile by the piston, is deformed to come into contact with the tubing wall.

The pile can comprise a metal anti-extrusion cup whose outside diameter is approximately the outside diameter of the valve body before compression of the pile.

The pile can consist of eight V-shaped cups made of HNBR type elastomer of Shore hardness A of about 80.

The pile can be mechanically held compressed by immobilization means of the compression sleeve.

The hydraulic communication means can consist of tubular elements assembled by connections, one end of a first element is connected to the body of said valve, one end of the upper element is connected to a hanger element.

The hanger element can be held in an adapter fastened to the wellhead and comprising hydraulic communication means with said tubular elements.

The adapter can include radial-displacement rams intended to close on said tubular elements.

The invention also relates to a method of setting the valve according to the invention in a production tubing, comprising the following stages:

assembling an adapter on the wellhead, lowering the valve into the tubing by assembling a number of tubular elements corresponding to the desired depth, suspending the valve and its tubular elements from the adapter by means of a hanger and connecting the hydraulic line of said tubular elements to a source of pressure at the surface, placing the valve under pressure so as to open the passage, anchor the body of the valve in the tubing at the depth at which it has been lowered and compress the pile of joints to obtain annular sealing.

According to the method, the well can be placed under safe conditions by decreasing the pressure in the valve so as to close said passage shutoff means without unlocking the anchor means or deactivating the pile of seal joints.

The tubular elements can be disconnected and pulled out of the hole before lowering a tool suited to be connected to the top of the valve body and to unlock by jarring the anchor means and the pile compression means.

BRIEF DESCRIPTION OF THE FIGURES

Other features and advantages of the present invention will be clear from reading the description hereafter, given by way of non limitative example, with reference to the accompanying drawings wherein.

DETAILED DESCRIPTION

Figure 1A:
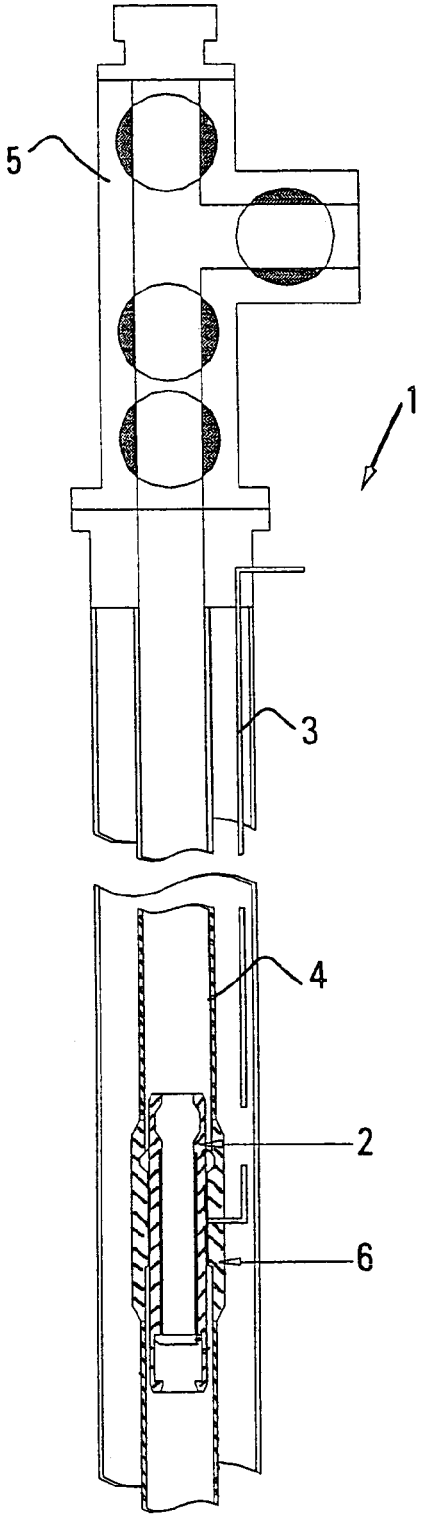
FIGS. 1A and 1B diagrammatically show a valve according to the prior art, FIGS. 2A and 2B diagrammatically show an installation comprising a valve according to the present invention.

FIG. 1A shows an oilwell 1 equipped with a subsurface safety valve 2 whose hydraulic control line 3 is defective. The well comprises a production tubing 4 communicating with a Christmas tree 5. This safety valve is positioned in a nipple 6. In order to repair the well and to bring it into conformity with standards, the valve has to be removed from its seat to set a new valve allowing to restore production as soon as possible, and in complete safety. If the control line is no longer operational, a safety valve can be set in seat or nipple 6, a valve such as the valve described in document FR-2,734,863 mentioned here by way of reference.

Figure 1B:
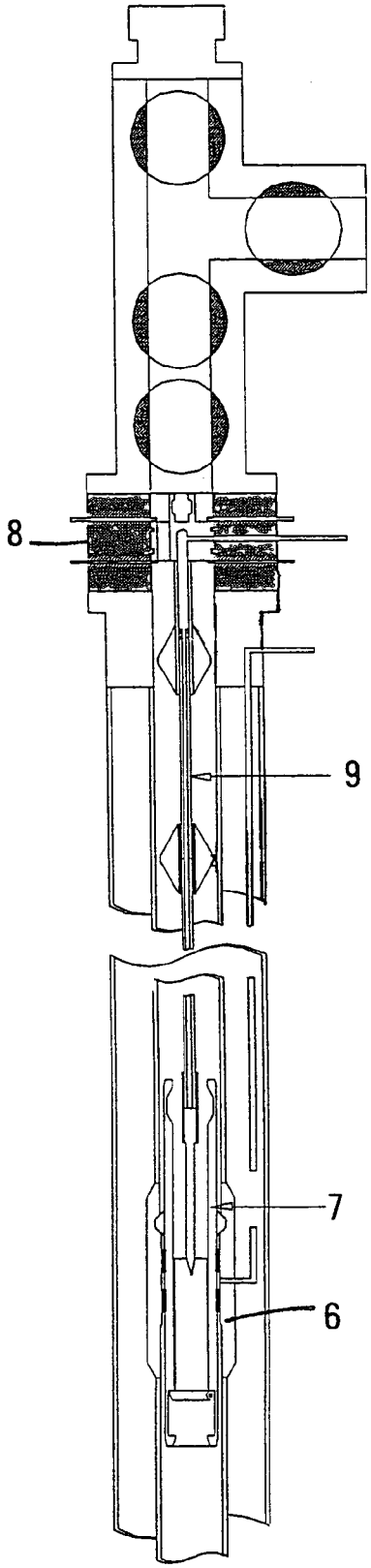

FIG. 1B shows this valve consisting of three main assemblies shutoff assembly 7, or the valve proper, controlled by hydraulic pressure, the assembly consisting of adapter and connecting flanges 8, the assembly consisting of connecting lines 9 between this adapter 8 and valve 7.

The details of these equipments and of the setting or operating procedures are clearly described in the aforementioned document. Considering the length fixed between the nipple and the position of adapter element 8, the number of rods 9 and their total length have to be determined according to the well considered.

Figure 2A:
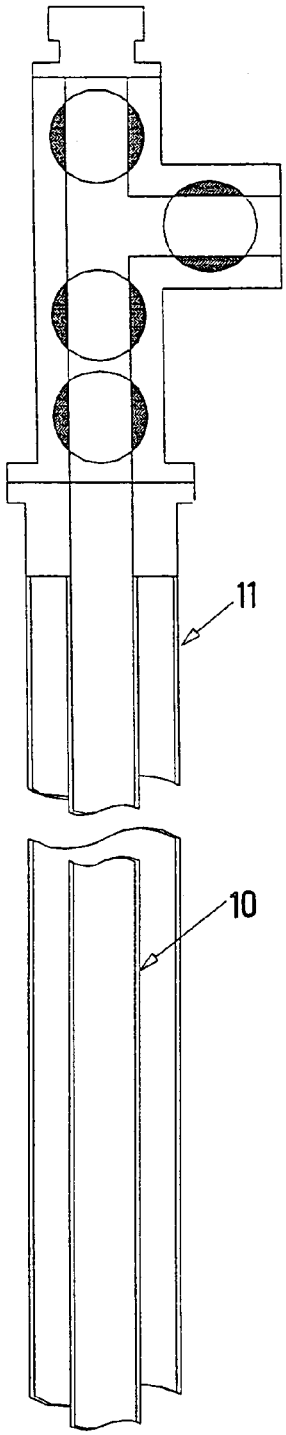

FIG. 2A shows a well 11 comprising a tubing 10 of known inside diameter. If it is necessary to add a safety valve inside this tubing, the system according to the invention, diagrammatically shown in FIG. 2B, can be advantageously used. An adapter 12 is interposed between master valves 13 and the tubing hanger. This device is similar to the one described in document FR-2,734,863 in that it has at least two functions: suspension of control rods 14 by means of lower lateral screws 50 and seal around hanger 21 so as to communicate with an outside hydraulic control line 15. However, according to the present variant, adapter 12 is also provided with two rams 51*a* and 51*b* allowing to manoeuvre the valve and the rod elements in the tubing. Thus, suspension and fastening of the rods is performed by tightening the rams on the rods. Control rods 14 can also be the rods used in the prior art. They can consist of a tubular element having a maximum length of approximately 6 meters and equipped at the end thereof with quick pin-to-box connections so as to be connected between elements. One of the rods is equipped with an expansion element or connection 16 for taking up the length variation of the whole of the rods, considering the possible temperature variations. Valve 17 comprises the following functional means:

shutoff means 18 for shutting off the inner channel of the valve body, anchor means 19 for anchoring valve 17 in tubing 10, sealing means 20 between the valve body and the inside of tubing 10.

In a variant, there are two anchor stages, in another variant, a single stage is necessary.

The valve is lowered after fitting the hanger element of tubing 10 with an adapter 12 which is used to suspend the whole of the system once it has been entirely lowered in the well, to maintain the connecting elements one after the other, to allow connection between them, and to lower the assembly stage after stage. The well being under pressure, an air lock mounted on the Christmas tree allows the procedure to be carried out in the well. This procedure is conventionally performed by means of a wireline. It consists in lowering the valve and the connecting elements in several stages. Stage 1: the valve hanging from its first rod element 14 is lowered until the upper part of the first element is held by the rams, thus allowing suspension and fastening of the first element on adapter 12. Stage 2: the standard rod element is lowered and connected to the first element hanging from adapter 12. The rams are then opened to allow descent of the first element fastened to the second rod element until the upper part of the standard element is held by the rams, thus allowing suspension and fastening of its two elements on adapter 12. Stage 3: this stage 3 is similar to stage 2 and multiplied as many times as necessary according to the number of rods required, considering the depth at which the valve is arranged. Last stage: this last stage consists in lowering the last element comprising, in the upper part thereof, hanger 21 and in connecting it to the last standard element held by the rams. The rams are then opened, thus allowing descent of the entire assembly and setting thereof, as well as locking of hanger 21 in adapter 12.

When a hydraulic pressure is applied in control line 15, the various functional means of valve 17 are activated, i.e. the valve opens after tilting of shutoff valve 18, anchor dogs 19 are expanded radially to immobilize the valve body in the tubing, the packer is compressed to rest against the tubing wall and form a seal.

Figure 3:
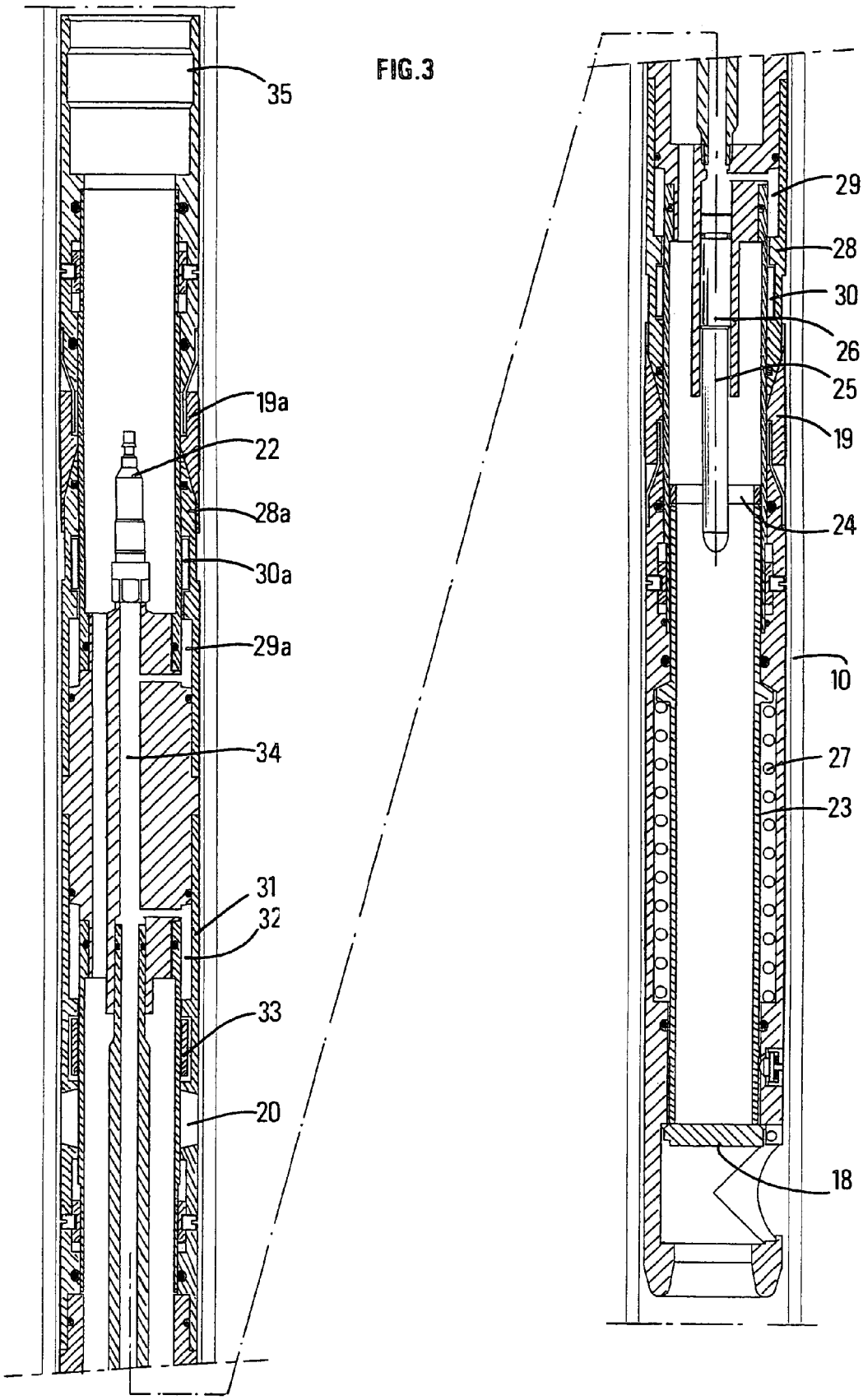
FIG. 3 is a lengthwise section of an embodiment of a valve according to the invention, FIGS. 4A and 4B diagrammatically show the principle of the sealing and anchor means of the valve according to the invention.

FIG. 3 shows, in sectional view, more details of the make-up of safety valve 17. Shutoff valve 18 is in closed position under the action of a spring (not shown). It is opened by displacement of a tube 23 under the thrust action of a ring 24 connected to a piston 25. In the presence of a sufficient hydraulic pressure in chamber 26, the piston is pressed against tube 23 by means of ring 24 until it compresses spring 27 and causes said tube to slide, which causes disk 18 to tilt. In the absence of pressure in chamber 26, return spring 27 pushes tube 23 back and the disk closes, thus restoring well safety.

Anchor dogs 19 are displaced radially by a piston 28 whose end has the shape of a cone on which said anchor dogs 19 rest. Piston 28 is pushed under the anchor dogs by the hydraulic pressure in chamber 29, the displacement of the piston blocking the anchor dogs on the wall of tubing 10. Means 30 for locking the position of anchor piston 28 allow this piston to be held in place even when the pressure has dropped in chamber 30. These locking means can work according to the principle of a dog stop or of teeth. FIG. 3 shows a second assembly: anchor dogs 19*a*, piston 28*a*, hydraulic chamber 29*a*, locking means 30*a*, in the upper part of the body of the pump. However, the invention is not limited to two anchor assemblies, and in most embodiments a single anchor assembly is necessary.

The present valve also comprises sealing means between the body of the valve and tubing 10. This assembly is an essential element insofar as, in case of failure, the safety valve is totally inoperative and it is delicate to form a seal on a raw surface such as the wall of a tubing. These sealing means include a packing assembly 20 which is activated on the tubing wall by a piston 31 displaced by the hydraulic pressure present in chamber 32. Locking means 33 hold piston 31 in place even without pressure in chamber 32.

Figure 2B:
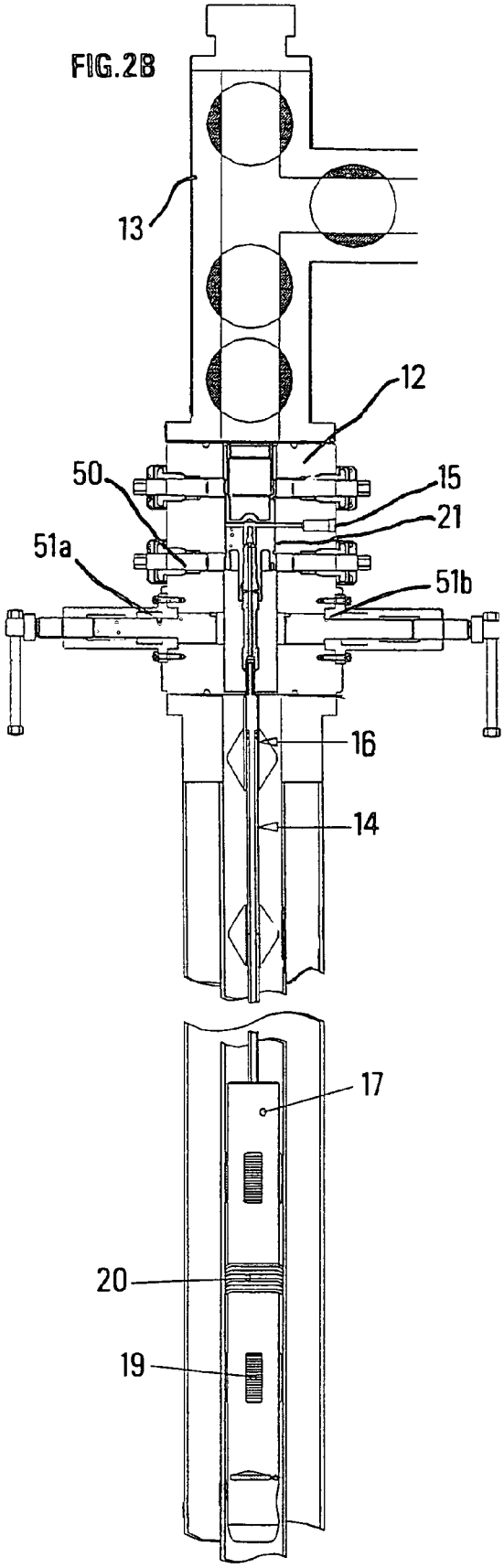

A line 34 communicating with a connector 22 distributes the hydraulic pressure in the chambers described above: valve opening chamber 26, anchor chamber(s) 29 and 29*a*, sealing means chamber 32. Connector 22 is connected to the surface by rods 14 (FIG. 2B). It can be noted that the hydraulic pressure rise in line 34 (approximately 35 MPa) transmits the pressure energy in all the chambers simultaneously, which provides substantially at the same time: opening of the valve, anchoring and sealing thereof in the tubing. When the hydraulic pressure drops in line 34, the valve closes but remains in position, anchored and sealed. A special profile 35 arranged at the top of the valve body allows to disanchor the valve body by traction and jarring by means of a fishing tool suited to this profile. By jarring on the valve body, a series of shear pins are broken, thus releasing anchor piston(s) 28, 28*a*, as well as sealing piston 31. The released valve can then be pulled up to the surface.

Figure 4A:
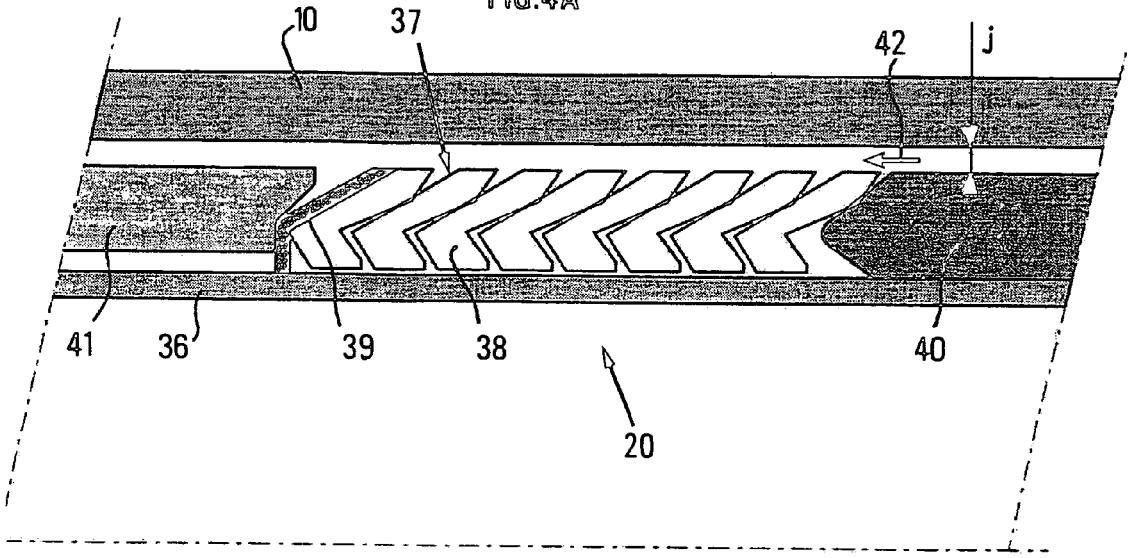
Figure 4B:
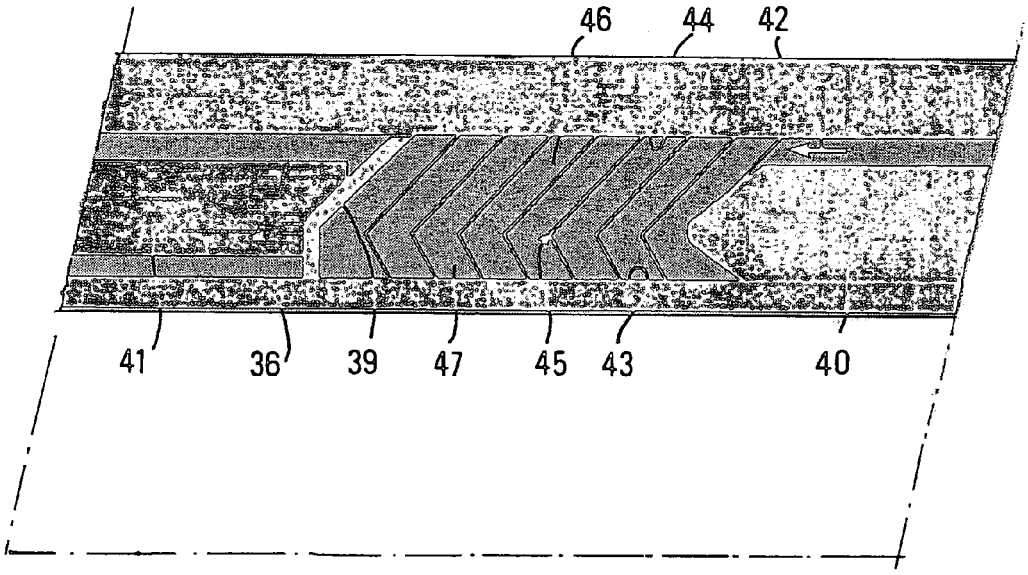

FIGS. 4A and 4B diagrammatically illustrate the principle of packing assembly 20 of the sealing means between packer holder 36 and tubing 10. Reference (j) designates the radial play between the outside diameter of packers 37 and the inside diameter of the tubing. This play is generally of the order of 2.5 mm, but it may reach 5 mm. The packing consists of a pile of eight cups 38 of optimized shape to withstand the pressure after being deformed against the tubing wall. Part 40 is the support against which the pile of cups 38 is compressed in a thrust load. Part 41 designates the nose of the piston (reference number 31 in FIG. 3). An anti-extrusion cup 39 is interposed between the first cup and piston nose 41. It can be noted that the pressure of the well applies in the direction shown by arrow 42.

The optimized shape of cups 38 results from the general herringbone U or V shape wherein the section of the cups exhibits a symmetry along an axis parallel to the central axis (one can refer to the technical handbook: "Seals and Sealing Handbook"—Ed. The Trade and Technical Press Limited, 1985). These seals are suitable for mounting without clearance adjustment, or of some tenths of a millimeter only. In fact, it has been verified that joints having sections with an axis of symmetry are not compatible with large clearance adjustments, for example above 2.5 mm, in particular in case of resistance to a pressure above 5000 PSI, i.e. about 350 MPa.

For a packer to be able to take up a clearance of some millimeters, it has been determined that the following notably have to be optimized: the deformation capacity of the material, the pressure resistance of this material, the level of the frictions on the packer holder so that the necessary deformations are obtained with lesser stresses.

FIG. 4B diagrammatically illustrates the whole of the packer once compressed by the action of piston 41. The inner part of the pile of cups forms a seal on the surface 43 of packer holder 36. Metallic anti-extrusion cup 39 deforms and presses against inner wall 44 of the tubing. The outer lip of the cups is raised to also rest on the tubing and close the annular space. Under pressure, as shown by arrow 42, the packers lean more heavily against the tubing while being held by the anti-extrusion cup.

The optimized shape of the sealing cups can be defined as follows: the section of the cup has the shape of a V one branch of which, in contact with the surface of the packer holder (inside diameter of the cup), is shorter 47. Thus, point 45 of the V is no longer in the median position of the annular space between the packer holder cylinder and the inner wall of the tubing, but it is offset and closer to the packer holder. Branch 46 of the V, which undergoes the most deformation, and which is on the side of play j, is the longer, which favours its displacement under the action of the piston. The shape of the end of the two branches of the unsymmetrical herringbone is suited to efficiently press against the cylindrical surfaces of the packer holder and of the tubing. Experience and finite-element calculations have shown that this unsymmetrical shape of the cups provides the most regular contact stresses and therefore good pressure resistance.

The material used can be HNBR rubber of Shore A hardness 80, which is also suited for standard temperatures in production wells.

According to the invention, the number of cups selected is eight in the case of a valve suited to be lowered into a tubing whose inside diameter is approximately 75 to 80 mm. The invention is not limited to this number of cups, which can vary depending on the operating pressure and/or on the nature of the fluids.

The invention claimed is:

1. A well safety valve set in a production tubing, comprising a body comprising shutoff means for shutting off an inner passage of said body, anchor means for anchoring said body in said tubing, sealing means between said body and a wall of the tubing, wherein said sealing means comprise a pile of several ring-type joints made of a resilient material that can be compressed by displacement of a compression sleeve of a hydraulic piston, and the section of said ring-type joints has the shape of a V with an unsymmetrical length of the branches thereof, the branch in inner contact with the valve body being the shorter, branch in contact with the tubing wall, after compression of the pile by the piston, is deformed to come into contact with the tubing wall, said valve comprising communication means for a hydraulic pressure between said valve and the surface of the well, wherein said shutoff, anchor and sealing means comprise hydraulic activation means such that said hydraulic pressure transmitted from the surface activates said means so as to open said passage, anchor the valve in the tubing and activate the sealing means on the tubing wall.

2. A valve as claimed in claim 1, wherein said shutoff means comprise a shutoff valve held in closed position by a return means, a hydraulic piston providing under pressure longitudinal displacement of a sleeve so as to keep said shutoff valve open.

3. A valve as claimed in claim 1, wherein said anchor means comprise rams that can be displaced radially against the tubing wall by an anchor sleeve of a hydraulic piston.

4. A valve as claimed in claim 3, wherein anchoring is mechanically locked by means (30*a*) for immobilizing the anchor sleeve.

5. A valve as claimed in claim 1, wherein said pile comprises a metal anti-extrusion cup whose outside diameter is approximately the outside diameter of the valve body before compression of the pile.

6. A valve as claimed in claim 1, wherein the pile is mechanically held compressed by means for immobilizing the compression sleeve.

7. A valve as claimed in claim 1, wherein the hydraulic communication means consist of tubular elements assembled by connections, one end of a first element is connected to the body of said valve, one end of the upper element is connected to a hanger element.

8. A valve as claimed in claim 7, wherein the hanger element is maintained in an adapter fastened to the wellhead and comprising means for hydraulic communication with said tubular elements.

9. A valve as claimed in claim 8, wherein said adapter comprises radial-displacement rams intended to close on said tubular elements.

10. A well safety valve set in a production tubing, comprising a body comprising shutoff means for shutting off an inner passage of said body, anchor means for anchoring said body in said tubing, sealing means between said body and a wall of the tubing, wherein said sealing means comprise a pile of several ring-type joints made of a resilient material that can be compressed by displacement of a compression sleeve of a hydraulic piston, and said pile consists of eight V-shaped cups made of HNBR type elastomer having a A Shore hardness of approximately 80, said valve comprising communication means for a hydraulic pressure between said valve and the surface of the well, wherein said shutoff, anchor and sealing means comprise hydraulic activation means such that said hydraulic pressure transmitted from the surface activates said means so as to open said passage, anchor the valve in the tubing and activate the sealing means on the tubing wall.

11. A valve as claimed in claim 10, wherein the pile is mechanically held compressed by means for immobilizing the compression sleeve.

12. A valve as claimed in claim 10, wherein the hydraulic communication means consist of tubular elements assembled by connections, one end of a first element is connected to the body of said valve, one end of the upper element is connected to a hanger element.

13. A valve as claimed in claim 12, wherein the hanger element is maintained in an adapter fastened to the wellhead and comprising means for hydraulic communication with said tubular elements.

14. A valve as claimed in claim 13, wherein said adapter comprises radial-displacement rams intended to close on said tubular elements.

15. A valve as claimed in claim 10, wherein said shutoff means comprise a shutoff valve held in closed position by a return means, a hydraulic piston providing under pressure longitudinal displacement of a sleeve so as to keep said shutoff valve open.

16. A valve as claimed in claim 10, wherein said anchor means comprise rams that can be displaced radially against the tubing wall by an anchor sleeve of a hydraulic piston.

17. A valve as claimed in claim 16, wherein anchoring is mechanically locked by means (30*a*) for immobilizing the anchor sleeve.

18. A valve as claimed in claim 10, wherein said pile comprises a metal anti-extrusion cup whose outside diameter is approximately the outside diameter of the valve body before compression of the pile.

19. A method for implementing a well safety valve set in a production tubing, the valve comprising shut off means for shutting off an inner passage of said body, anchor means for anchoring said body in said tubing, sealing means between said body and a wall of the tubing, said valve comprising communication means for a hydraulic pressure between said valve and the surface of the well, wherein said shutoff, anchor and sealing means comprise hydraulic activation means such that said hydraulic pressure transmitted from the surface activates said means so as to open said passage, anchor the valve in the tubing and activate the sealing means on the tubing wall, the method comprising the following stages:

assembling an adapter on the wellhead, lowering the valve into the tubing by assembling a number of tubular elements corresponding to the desired depth, suspending the valve and its tubular elements from the adapter by means of a hanger and connecting the hydraulic line of said tubular elements to a source of pressure at the surface, placing the valve under pressure so as to open the passage, anchor the body of the valve in the tubing at the depth at which it has been lowered and compress the pile of joints to obtain annular sealing, wherein the tubular elements are disconnected and pulled out of the hole before lowering a tool suited to be connected to the top of the valve body and to unlock by jarring the anchor means and the pile compression means.

* * * * *